US006622412B1

(12) United States Patent
Wilkes

(10) Patent No.: US 6,622,412 B1
(45) Date of Patent: Sep. 23, 2003

(54) ABOVE BARREL GRIP APPARATUS

(76) Inventor: Dave Wilkes, 10650 N. Burma, Claremore, OK (US) 74017

( * ) Notice: Subject to any disclaimer, the term of this patent is extended or adjusted under 35 U.S.C. 154(b) by 11 days.

(21) Appl. No.: 09/854,087

(22) Filed: May 11, 2001

(51) Int. Cl.[7] ..... F41C 23/00
(52) U.S. Cl. ..... 42/72
(58) Field of Search ..... 42/72, 71.01, 106

(56) References Cited

U.S. PATENT DOCUMENTS 3,512,290 A * 5/1970 Violette et al. ..... 42/75.01
3,623,257 A * 11/1971 Ray ..... 42/71.01
3,939,589 A * 2/1976 Tellie ..... 42/140
4,321,765 A * 3/1982 Gillum ..... 42/72
4,502,238 A 3/1985 Farrar et al. ..... 42/72
4,579,037 A * 4/1986 Gillum ..... 42/72
4,827,652 A * 5/1989 Martin ..... 42/111
4,837,961 A * 6/1989 Keenan ..... 42/72
5,027,542 A 7/1991 Simonetti ..... 72/72
5,068,992 A * 12/1991 Velezis et al. ..... 42/72
5,417,002 A * 5/1995 Guerra ..... 42/72
5,852,253 A * 12/1998 Baricos et al. ..... 102/439
6,397,507 B1 * 6/2002 Marshall et al. ..... 42/106

* cited by examiner

*Primary Examiner*—Michael J. Carone
*Assistant Examiner*—M. Thomson
(74) *Attorney, Agent, or Firm*—Capehart Law Firm, P.L.L.C.; Brent A. Capehart

(57) ABSTRACT

A gun having a forearm element having an above barrel handle to assist with the facilitation of holding, loading successive rounds of ammunition, cocking and other manipulation of such gun.

9 Claims, 1 Drawing Sheet

ABOVE BARREL GRIP APPARATUS

BACKGROUND OF THE INVENTION

1. Field of the Invention

The present invention generally relates to a gun grip. More specifically, the present invention is directed toward a gun having an above-barrel forehand element.

2. Background

Guns having forearm grips are known in the prior art. The most common of which is the pump action shotgun. This type of gun typically has a below barrel forehand element serving to facilitate holding, cocking and other manipulation of the gun while in use. Various modifications to this element have been disclosed in the prior art. For example, U.S. Pat. No. 4,502,238 issued to Farrar on Mar. 5, 1985, entitled Pump Gun Forend discloses a below barrel grip for assisting in the loading of ammunition, cocking and other manipulation of the gun. Other variations demonstrating the below barrel grip are disclosed in U.S. Pat. No. 5,027,542 issued to Simonetti on Jul. 2, 1991, entitled Handle for a Forearm Stock of a Pump Action Gun and U.S. Pat. No. 5,068,992 issued to Velezis on Dec. 3, 1991, entitled Forearm Assembly.

The below barrel forehand element have some disadvantages. Due to the natural recoil of a gun being in a generally upward direction, a large amount of strength must be needed in order to prevent any loss of control over the gun. Additionally, the user of the gun begins to lose control when the gun is in a firing position for an extended time. Accordingly, there is a need for a gun forearm that provide better control before, during and after the firing of the gun.

SUMMARY OF THE INVENTION

The present invention satisfies the needs discussed above. The present invention is generally directed toward a forearm for a gun, more specifically toward forearm for a gun having an above barrel handle.

The present invention provides a forearm structure of a gun in order to facility the holding, cocking and loading of ammunition and other manipulation of the gun. More specifically, the present invention is directed toward a handle positioned above the barrel of the gun and connected to the below barrel grip. The device is designed to facilitate right or left handed use and is made from sturdy, resilient material. An additional aspect of the present invention discloses the grip being positioned in such a manner as not to interfere with the sighting mechanisms of the gun.

The term gun as used herein can represent a pump-action type gun to manually load ammunition, such as but not limited to a pump-action shotgun, or an automatically loading gun, such as but not limited to an automatic feed shotgun.

In one aspect, the present invention provides a gun comprising of a barrel, a magazine tube extending adjacent and essentially parallel said barrel, and a forearm adapted to be mounted about said magazine tube, said forearm having a grip and a handle connected to said grip, said handle being located above said barrel.

In another aspect, the present invention provides a gun comprising of a barrel, a magazine tube extending adjacent and essentially parallel said barrel, and a removably secured forearm adapted to be mounted about said magazine tube, said forearm having a grip and a handle connected to said grip, said handle being located above said barrel.

In yet another aspect, the present invention provides a pump forearm for a gun comprising a grip and a handle connected to said grip, said handle being located above said barrel.

In yet another aspect, the present invention provides a removably secured forearm for a gun comprising a grip and a handle connected to said grip, said handle being located above said barrel.

Further objects, features and advantages of the present invention will be readily apparent to those skilled in the art upon reference to the accompanying drawings and upon reading the following description of the preferred embodiments.

DESCRIPTION OF THE PREFERRED EMBODIMENT

Before explaining the present invention in detail, it is to be understood that the invention is not limited in its application to the details of the construction and arrangement of parts illustrated in the accompanying drawings. The invention is capable of other embodiments and of being practiced or carried out in a variety of ways. It is to be understood that the phraseology and terminology employed herein is for the purpose of description and not of limitation.

Figure 1:
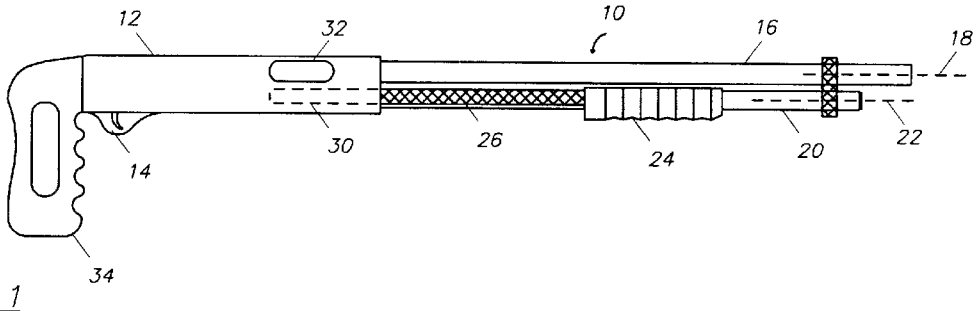
FIG. 1 PRIOR ART
FIG. 1 is a side view of a prior art gun.

As depicted in FIG. 1, a prior art gun 10 is shown. Gun 10 includes a receiver 12 which houses a firing mechanism actuated by a trigger 14 to fire a shotgun shell received in the rear portion of barrel 16. This portion of barrel 16 is connected at its rear end to the receiver 12 and projects forwardly therefrom along an axis 18. A magazine tub 20 extends along an axis 22 parallel to and directly beneath axis 18 and is adapted to contain a series of shotgun shells which are successively moved rearwardly from the tub 20 into the receiver 12 for delivery into the barrel 16. A grip 24 is disposed of about tube 20 and is manually reciprocal along axis 22, relative to the tube between the full line forward position A and rear position B. Grip 24 is connected to two conventional parallel action bars 26 which extend rearwardly along the underside of the barrel parallel thereto into receiver 12 and function to actuate the firing mechanism 30, and cocking it as a result of rearward movement of grip 24. The rearward and then the forward reciprocation of grip 24 also functions to eject a spent shell from the receiver 12 and the gun through a side entry 32 and to feed the next successive shell to the barrel 16 followed by automatic closure of the rearend of the barrel 16 in preparation of the firing of that shell by actuation of trigger 14. Gun 10 typically has a pistol-type handle 34 or a conventional rearward projecting stock not shown.

Figure 2:
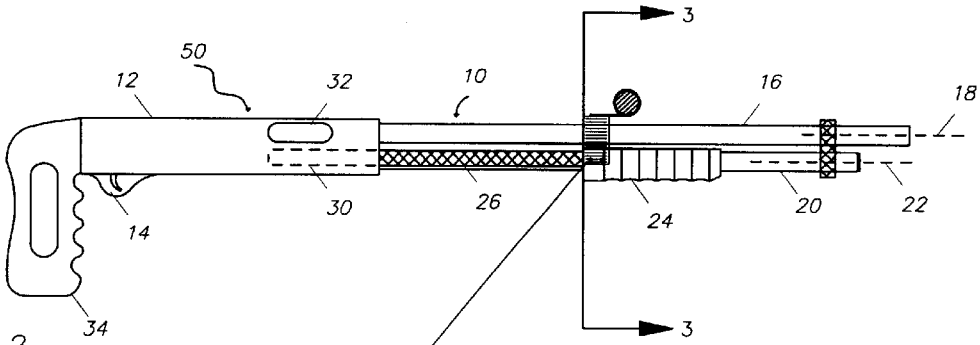
FIG. 2 is a side view of embodiment 50 a pump-action type shotgun having a forearm assembly provided by the present invention.
Figure 3:
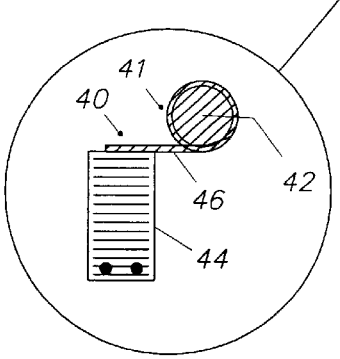
FIG. 3 is a cross sectional view along line 3 from FIG. 2.
Figure 3:
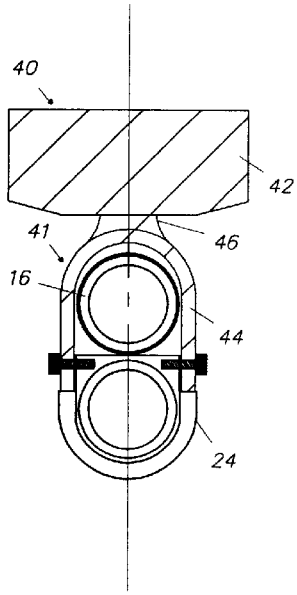

As depicted in FIGS. 2 and 3, an embodiment 50 of the present invention comprises a pump forearm 40 adapted to be mounted about magazine tube 20. Pump forearm 40 comprises a grip 24 and a handle assembly 41 connected to grip 24, proximate the rearward (toward the butt end) end. Handle assembly 41 is located about and above barrel 16 and has securing element 44 connected to hand grip 42 by a neck element 46. The connection of hand grip 42 to neck element 46 is such that it facilitates either right-handed or left-handed use, and places hand grip 42 forward (toward the muzzle end) of securing element 44.

It will be understood by those skilled in the art that handle assembly 41 can be removably or permanently attached to grip 24.

As shown in FIGS. 2 and 3, one embodiment of securing element 44 is to be designed in a substantially U-shape on order to be positioned around barrel 16 while being secured in the region of grip 24. By being positioned around barrel 16, handle assembly 41 is able to effectuate the loading and cocking features of a conventional pump type gun without interfering with the standard function of such a gun.

In operation, a person may first load into the gun a series of shells into magazine tube 20 by inserting them forwardly into the magazine through receiver 12. A first shell is then fed into the firing chamber and the gun is cocked by grasping handle 42 which is connected to grip 24 and moving such handle 42 from position A rearward to position B and then returning to forward position A. The gun is then ready to be fired. During the firing of the gun, a user may grasp handle 42 to provide additional support and stability during such firing.

It will be understood by those skilled in the art that while only a pump-action type shotgun has been illustrated, other type of guns, such as but not limited to automatic loading shotguns, can be outfitted with the forehand grip of the present invention.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art.

What is claimed is:

1. A gun comprising of:

a barrel;

a magazine tube extending adjacent and essentially parallel said barrel; and a forearm adapted to be mounted about said magazine tube, said forearm having a grip and a handle assembly, said grip having a forward end and a rearward end, and said handle assembly having a securing element and a hand grip and being located about and above said barrel, said securing element being connected to said grip proximate said rearward end of said grip and said hand grip being connected to said securing element forward of said securing element.

2. The gun of claim 1 wherein said handle is removably secured to said forearm.

3. The gun of claim 1 wherein said gun is a pump-action type shotgun.

4. The gun of claim 1 wherein said is an automatic load type shotgun.

5. The gun of claim 1 wherein said handle assembly comprises:

a securing element and a hand grip connected thereto by a neck element.

6. The gun of claim 5 wherein said securing element is substantially U-shaped.

7. The gun of claim 1 wherein said handle assembly is removably secured to said grip.

8. A forearm for a gun, said gun being a pump action type shotgun having a barrel, said forearm comprising:

a grip having a forward end and a rearward end; and a handle assembly having a securing element and a hand grip and being located about and above said barrel, said securing element being connected to said grip proximate said rearward end of said grip and said hand grip being connected to said securing element forward of said securing element.

9. The gun of claim 8 wherein said gun is an automatic load type shotgun.

* * * * *